US005279136A

United States Patent [19]

Perry

[11] Patent Number: 5,279,136

[45] Date of Patent: Jan. 18, 1994

[54] CABLE SECURITY DEVICE

[76] Inventor: Robert C. Perry, 5755 SW. Willow La., Lake Oswego, Oreg. 97035

[21] Appl. No.: 20,243

[22] Filed: Feb. 19, 1993

Related U.S. Application Data

[63] Continuation of Ser. No. 874,515, Apr. 27, 1992, abandoned.

[51] Int. Cl.[5] ..... E05B 73/00

[52] U.S. Cl. ..... 70/18; 70/58; 206/408; 206/495; 242/85.1

[58] Field of Search ..... 70/18, 30, 49, 58, 63, 70/233; 206/408, 395; 242/85.1

[56] References Cited

U.S. PATENT DOCUMENTS

| | | | |
|---|---|---|---|
| 1,545,660 | 7/1925 | Johnson | 70/49 |
| 3,033,360 | 5/1962 | Ledoux | 242/85.1 |
| 3,202,372 | 8/1965 | Meline et al. | 242/85.1 |
| 3,531,955 | 10/1970 | Taylor et al. | 70/18 |
| 4,023,387 | 5/1977 | Gould | 70/49 X |
| 4,064,714 | 12/1977 | Treslo | 70/18 |
| 4,067,526 | 1/1978 | Storer | 242/85.1 X |
| 4,404,822 | 9/1983 | Green | 70/49 X |
| 4,664,260 | 5/1987 | Stokes | 206/408 X |
| 4,811,577 | 3/1989 | Webster et al. | 70/49 X |
| 4,846,343 | 7/1989 | Rupert | 206/408 X |

FOREIGN PATENT DOCUMENTS

| | | | |
|---|---|---|---|
| 132445 | 7/1902 | Fed. Rep. of Germany | 70/233 |
| 3928799 | 5/1991 | Fed. Rep. of Germany | 70/58 |
| 7806670 | 12/1979 | Netherlands | 70/18 |
| WO83/00354 | 2/1983 | PCT Int'l Appl. | 70/233 |
| 494475 | 10/1938 | United Kingdom | 70/49 |

*Primary Examiner*—Lloyd A. Gall

*Attorney, Agent, or Firm*—Smith-Hill and Bedell

[57] ABSTRACT

A security device for securing an article against theft comprises a flexible cable having first and second opposite ends, and a housing member defining a cavity for receiving the cable. The housing member has a wall formed with an opening through which the cable may extend. A cable retainer retains the first end of the cable substantially stationarily inside the housing. On withdrawing the second end of the cable from the housing, no substantial return force tending to retract the cable into the housing is generated.

9 Claims, 2 Drawing Sheets

CABLE SECURITY DEVICE

This is a continuation of application Ser. No. 07/874,515 filed Apr. 27, 1992 and now abandoned.

BACKGROUND OF THE INVENTION

This invention relates to a security device.

Unauthorized removal of components of personal computers represents a major security problem in certain institutions, such as colleges, where there are not elaborate security measures restricting access to the institution, so that the institution is, in effect, open to the public, and the legitimate users of the institution may need access to personal computers in order to carry out their studies.

SUMMARY OF THE INVENTION

According to the present invention there is provided a security device comprising a flexible cable having first and second opposite ends, a housing member defining a cavity for receiving the cable, the housing member having a wall formed with an opening through which the cable may extend, and there being retainer means for retaining the first end of the cable substantially stationarily inside the housing, whereby on withdrawing the second end of the cable from the housing, no substantial return force tending to retract the cable into the housing is generated.

BRIEF DESCRIPTION OF THE DRAWINGS

For a better understanding of the invention, and to show how the same may be carried into effect, reference will now be made by way of example, to the accompanying drawings in which.

DETAILED DESCRIPTION

Figure 1:
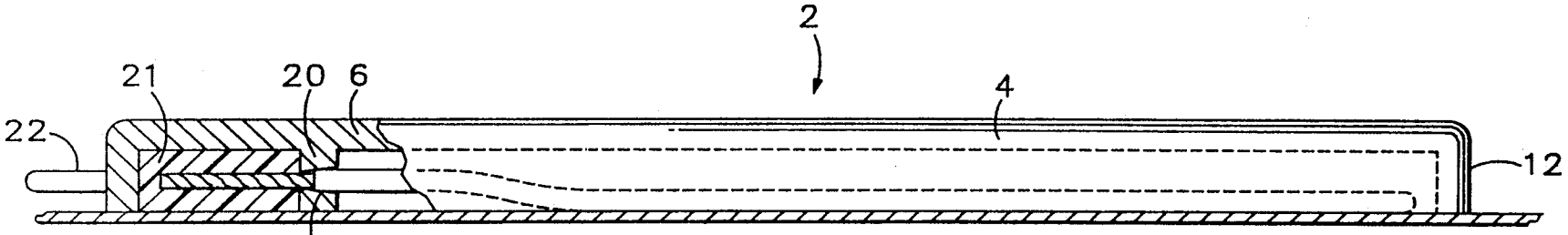
FIG. 1 is a partially broken away side view of a first security device.
Figure 2:
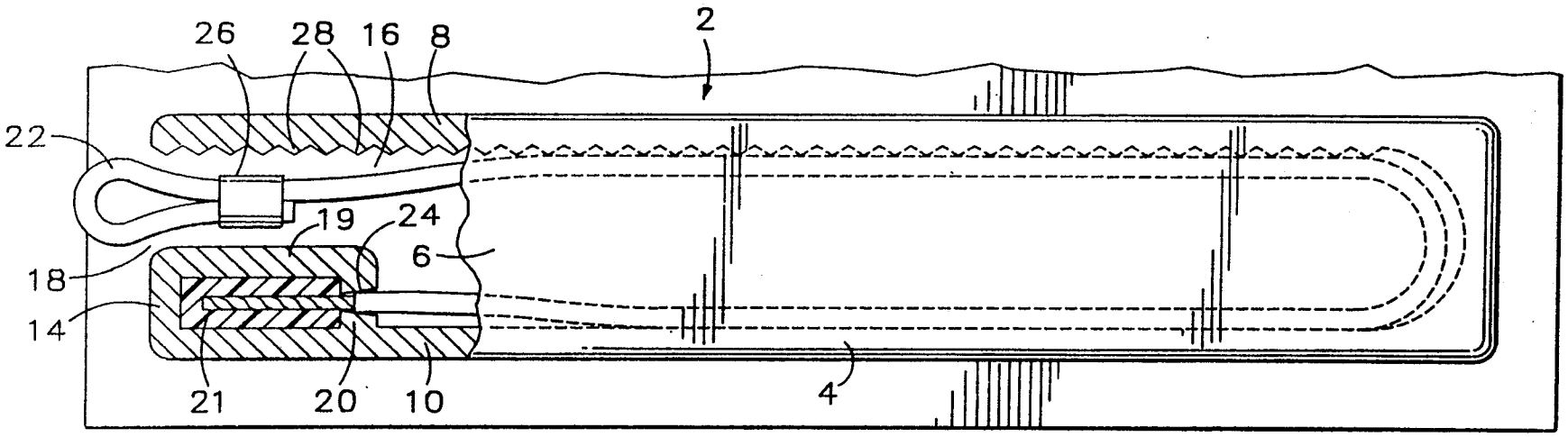
FIG. 2 is a partially broken away top view of the security device shown in FIG. 1.

The security device 2 that is shown in FIGS. 1 and 2 is designed particularly for securing a lap top computer or other article having a flat surface that is fairly narrow but quite long. The security device 2 comprises a housing member 4 that is made of molded synthetic polymer material. The housing member has a top wall 6, two longitudinal side walls 8, 10 and two end walls 12, 14. The end wall 12 joins the two longitudinal side walls, whereas the wall 14 projects from the longitudinal wall 10 towards the wall 8 but is separated therefrom by an opening 18. The housing member therefore defines a recess 16 and the opening 18 gives access to the recess. Two interior walls 19 and 20 connect the end wall 14 to the side wall 10 to form a cable retainer cell 21 within the recess 16.

The security device shown in FIGS. 1 and 2 also comprises a length of cable, typically steel cable having a jacket of synthetic polymer material, preferably a material containing both nylon and PTFE. The cable is provided at one end with a ferrule 26 forming a loop 22 and is stripped at its opposite end to expose the cable's steel strands. The wall 20 is formed with a tapered bore 24 whose maximum diameter is slightly greater than the diameter of the jacket and whose minimum diameter is less than the diameter of the jacket but greater than the diameter of the core of the cable. When the security device is assembled, the stripped end of the cable is inserted into the cable retainer cell through the tapered bore 24, and the jacket enters the bore but does not project into the cable retainer cell. The composition of the material of the jacket facilitates insertion of the jacket into the bore. The retainer cell is then filled with liquid epoxy adhesive, which bonds firmly to the core of the cable. The jacket of the cable serves to seal the bore and prevent adhesive leaking from the retainer cell. When the epoxy adhesive cures, the stripped end of the cable is secured firmly to the housing member. The cable extends as shown in FIG. 2 adjacent the interior surfaces of the housing member, and the loop 22 projects slightly from the opening 18.

When the cable has been installed as shown in FIG. 2, the housing member is attached to a substantially flat surface of the article that is to be secured against theft.

A high strength adhesive having gap-filling properties, such as the adhesive sold by Spacer Tech under the trademark ZAP GAP, is used to attach the housing member to the article that is to be secured against theft. If convenient, the case of the article may be opened and holes drilled in the case so that they register with internally threaded holes (not shown) in the housing member. Screws inserted into the holes from the interior of the case can then be used to further secure the housing member to the article. The security device is then attached to an anchor point, typically by use of a secondary cable that extends through the loop 22. When the article is not in use, the cable may be fed into the housing and the article placed adjacent the secure point. By feeding the cable into the housing, unsightly and possibly dangerous lengths of loose cable are avoided. When the article is in use, the cable is pulled from the cavity, and the article can be moved within the range permitted by the cable. There is no force tending to retract the cable into housing, such as might disturb or irritate the user of the article.

When the cable is being fed into or withdrawn from the cavity 16, friction between the cable and the wall 8 creates a force that resists movement of the cable relative to the housing member. It is desirable that this force be minimized. The composition of the material of the jacket of the cable helps to minimize the frictional force between the cable and the wall 8. Moreover, the interior surface of the side wall 8 is not flat but is formed with protrusions or ribs 28 so that when the cable is being fed into or withdrawn from the cavity 16, the segment of cable that is adjacent the wall 8 is not in contact with the wall 8 over its entire length.

Figure 3:
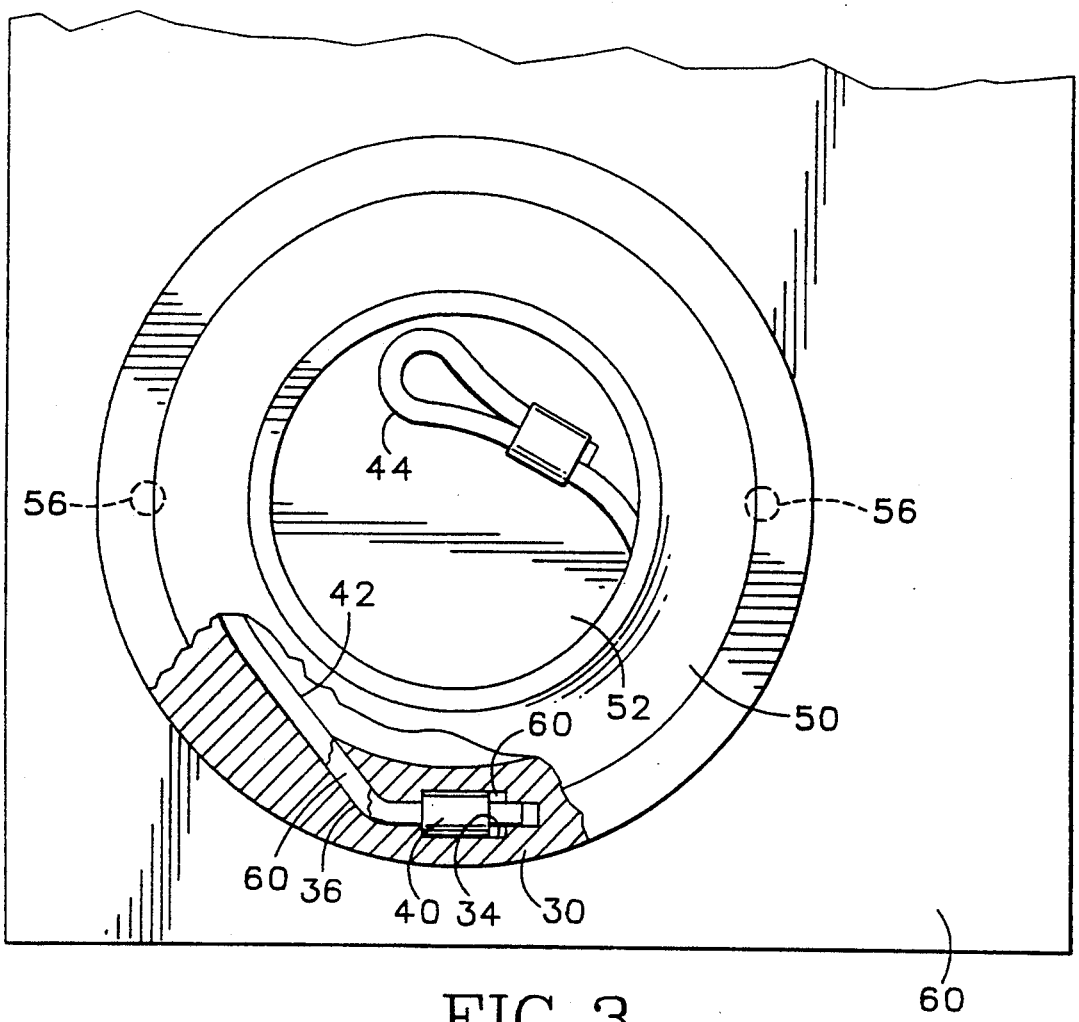
FIG. 3 is a partially broken away top view of a second security device.
Figure 4:
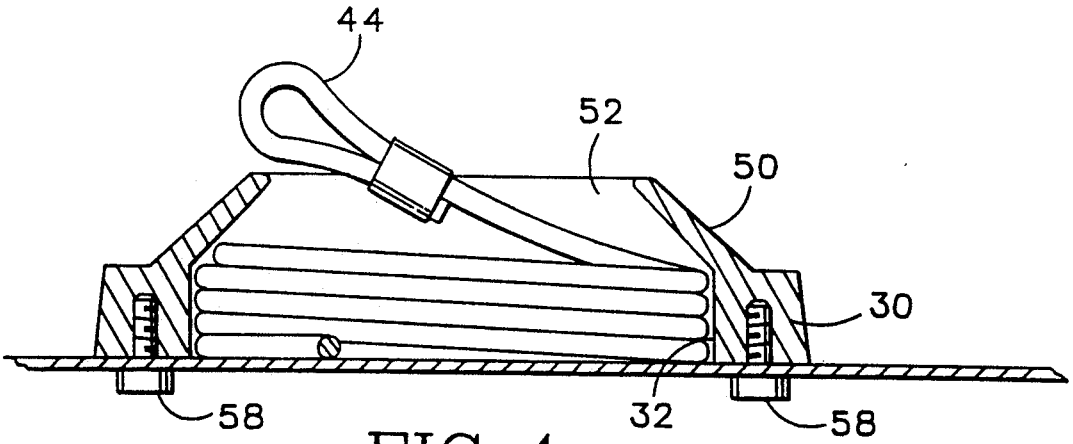
FIG. 4 is a sectional view of the device shown in FIG. 3.

The security device shown in FIGS. 3 and 4 is similar in some ways to the anchor shown in FIGS. 1 and 2. The security device shown in FIGS. 3 and 4 comprises a housing member having an annular wall 30 defining a main cavity 32. The annular wall 30 is formed with a smaller cavity 34 that communicates with the main cavity 32 by way of a channel 36. The cavity 34 and the channel 36 are open at the bottom of the annular wall 30. The smaller cavity 34 is dimensioned to receive a cable stop ferrule 40 that is attached to a cable 42 at one end, and the cable extends into the main cavity 32 by way of the channel 36. The cable 42 has a loop 44 at its free end. The housing member also has a cover portion that projects from the annular wall 30 and defines a front opening 52 that is smaller in diameter than the main cavity 32 and gives access to the cavity 32. The security device is assembled by fitting the ferrule 40 of the cable into the smaller cavity 34 and extending the cable through the channel 36 and out of the main cavity 32 by way of the front opening 52. The smaller cavity is then filled with epoxy adhesive, and when the adhesive is cured, the end of the cable is secured firmly to the housing member. The security device can then be attached to a computer, for example the bottom surface 60 of a lap top computer, by use of a gap-filling adhesive of the kind mentioned previously. If convenient, the computer case may be opened and two holes drilled in the computer case so that they register with two internally threaded holes 56 in the annular wall 30 of the housing member. Screws 58 inserted into the annular wall from the interior of the computer case can then be used to further secure the housing to the computer. The loop at the free end of the cable is attached to an anchor point, for example by use of a secondary cable. When the computer is not in use, the cable may be fed into the housing, and the cable coils against the interior surface of the annular wall as shown in FIG. 4. When the computer is to be used, the cable may be withdrawn from the housing, and the computer can then be moved easily within the range permitted by the full length of the cable without being subject to annoying return forces.

It will be appreciated that the invention is not restricted to the particular embodiments that have been described, and that variations may be made therein without departing from the scope of the invention as defined in the appended claims and equivalents thereof.

I claim:

1. A security device comprising a flexible cable having first and second opposite ends, a housing defining a cavity for receiving the cable, the housing having a wall formed with an opening through which the cable may extend, the cross-sectional area of the opening being substantially greater than the cross-sectional area of the cable, such that he cable can be inserted into and withdrawn from the cavity through the opening without substantial friction due to engagement of the cable with surfaces bounding the opening, and there being retainer means for retaining the first end of the cable substantially stationarily inside the housing, and there being no retraction mechanism of applying tension to the cable to retract the cable into the cavity, wherein said housing has a bottom surface and the retainer means comprises a recess that is formed in said housing and is open at said bottom surface and communicates with the cavity by way of a passage, the first end of the cable extends into the recess by way of said passage, and said cable has an enlarged portion at its first end, whereby the first end of the cable is retained against removal from the recess.

2. A device according to claim 1, wherein the cavity is elongated and has two opposite ends, the opening being at one end of the cavity and the retainer means being adjacent the opening, whereby when the cable is fully inserted into the cavity it extends from the retainer means along one longitudinal edge of the cavity and back to the opening along an opposite longitudinal edge of the cavity in two substantially parallel runs.

3. A device according to claim 2, wherein the housing has first and second longitudinal walls that extend from said one end of the cavity to the opposite end of the cavity, and wherein the retainer means is adjacent the first longitudinal wall and the second longitudinal wall is formed with a plurality of protrusions or ribs that extend transverse to the direction the cable is fed into or withdrawn from the cavity and wherein said protrusions or ribs have a pitch substantially less than the length of said second longitudinal wall, whereby when the cable is being fed into or withdrawn from the cavity and a segment of cable is adjacent said second longitudinal wall, such segment is not in contact with that wall over the entire length of said segment.

4. In combination, a device according to claim 1 and an article that is to be secured, said article having a substantially flat surface and the bottom surface of said housing being substantially flat, and said security device being attached to the article with the bottom surface of said housing in direct contact with said flat surface, whereby said recess is not readily accessible except by removal of the security device from the article.

5. A security device comprising a flexible cable having first and second opposite ends, a housing defining a cavity for receiving the cable, the housing comprising a first wall portion having a substantially cylindrical interior surface and a cover portion having an interior surface that tapers from the first wall portion to a location that is spaced from the first wall portion and at which the cover portion defines an opening through which the cable may extend, whereby when the cable is fully inserted in the housing it is wound substantially helically against said interior surface of said first wall portion and said second end of the cable can project from the housing through said opening, and there being retainer means for retaining the first end of the cable substantially stationarily inside the housing, whereby on withdrawing the second end of the cable from the housing, no substantial return force tending to retract he cable into the housing is generated, wherein said first wall portion has a bottom surface remote from said cover portion, and the retainer means comprise a recess that is formed in said first wall portion and communicates with the cavity by way of a channel, said recess and said channel being open at said bottom surface of the first wall portion, whereby a ferrule attached to the cable at its first end can be placed in the recess and the cable fed into the cavity by way of the channel.

6. A device according to claim 5, wherein the interior surface of said cover portion tapers in substantially conical fashion.

7. A device according to claim 5, wherein the diameter of said opening is substantially less than the diameter of said substantially cylindrical interior surface and substantially greater than the diameter of the cable.

8. A security device comprising a flexible cable having first and second opposite ends, a housing defining a cavity for receiving the cable, the housing having a wall formed with an opening through which the cable may extend, the cross-sectional area of the opening being substantially greater than the cross-sectional area of the cable, such that the cable can be inserted into and withdrawn from the cavity through the opening without substantial friction due to engagement of the cable with surfaces bounding the opening, and there being retainer mans for retaining the first end of the cable substantially stationarily inside the housing, the cavity being elongated and having two essentially straight longitudinal sides each extending substantially the entire distance from one end of the cavity to an opposite end of the cavity, the opening being at said one end of the cavity and the retainer means being adjacent the opening, whereby when the cable is fully inserted into the cavity it extends from the retainer means along one longitudinal side of the cavity and back to the opening along an opposite longitudinal side of the cavity in two substantially straight parallel runs.

9. A device according to claim 8, wherein the housing has first and second longitudinal walls that extend from said one end of the cavity to the opposite end of the cavity, and wherein the retainer means comprise a retainer cell adjacent the first longitudinal wall and the second longitudinal wall is formed with a plurality of protrusions or ribs that extend transverse to the direction the cable is fed into or withdrawn from the cavity and wherein said protrusions or ribs have a pitch substantially less than the length of said second longitudinal wall, whereby when the cable is being fed into or withdrawn from the cavity and a segment of cable is adjacent said second longitudinal wall, such segment is not in contact with that wall over the entire length of said segment.

* * * * *